US006476367B2

(12) United States Patent
Maung

(10) Patent No.: US 6,476,367 B2
(45) Date of Patent: Nov. 5, 2002

(54) AUTO-BAKE OUT SYSTEM

(75) Inventor: Myo Myint Maung, Singapore (SG)

(73) Assignee: Chartered Semiconductor Manufacturing Ltd., Singapore (SG)

( * ) Notice: Subject to any disclaimer, the term of this patent is extended or adjusted under 35 U.S.C. 154(b) by 16 days.

(21) Appl. No.: 09/785,117

(22) Filed: Feb. 20, 2001

(65) Prior Publication Data

US 2002/0113065 A1 Aug. 22, 2002

(51) Int. Cl.[7] ..... H05B 6/10; H05B 6/06

(52) U.S. Cl. ..... 219/635; 219/663; 219/667; 219/494; 219/651; 118/726

(58) Field of Search ..... 219/635, 638, 219/647, 651, 650, 663, 661, 665, 667, 494; 118/726, 725, 728, 733

(56) References Cited

U.S. PATENT DOCUMENTS 4,816,098 A * 3/1989 Davis et al. ..... 118/728
5,336,324 A 8/1994 Stall et al. ..... 118/719
5,883,017 A 3/1999 Tepman et al. ..... 438/800
5,906,680 A 5/1999 Meyerson ..... 117/88
5,910,210 A * 6/1999 Violi et al. ..... 219/620
6,028,297 A * 2/2000 Hamada et al. ..... 219/625

* cited by examiner

*Primary Examiner*—Philip H. Leung
(74) *Attorney, Agent, or Firm*—George O. Saile; Rosemary L. S. Pike

(57) ABSTRACT

Described is a system designed to warm the transfer chamber used in vacuum equipment in the manufacture of integrated circuits during maintenance. The system detects when the transfer chamber lid is opened and the chamber is exposed to the atmosphere. This activates the heater normally used to bake out the chamber. A temperature sensor is used to keep the temperature below a set point. By warming the chamber, moisture build-up on the inside of the chamber during maintenance is minimized, thereby reducing out gassing and time required to bring the chamber back to its base vacuum pressure when returned to production.

23 Claims, 3 Drawing Sheets

AUTO-BAKE OUT SYSTEM

BACKGROUND OF THE INVENTION (1) Field of the Invention

The invention generally relates to a method and apparatus used in semiconductor manufacturing and, more particularly, to a system used to remove moisture from a chamber in a high-vacuum metal deposition system in the fabrication of integrated circuits.

(2) Description of Prior Art

High-vacuum metal deposition systems used widely in semiconductor processing normally have chambers kept at sub-atmospheric pressure and wafers are moved into and out of the deposition chamber through a load lock system. During preventative maintenance or corrective maintenance, the transfer chamber must be opened. This exposes the transfer chamber to the atmosphere allowing the metal to absorb moisture. When the maintenance is completed, a rate of rise (ROR) test is performed. The chamber is pumped down to a specific pressure using the roughing pump and thereafter the chamber is sealed by closing the roughing valve. The chamber pressure is monitored and the increase in pressure is recorded. Because of outgassing, the ROR test always fails thereby placing additional load on the transfer cryogenic pump. To remedy this problem, there is a bake-out procedure used to reduce the moisture and subsequent outgassing. The Applied Materials Endura System has a transfer bake-out procedure whereby high vacuum and high temperature (96° C.) are employed. Typically, the bake-out takes about one hour and an additional five hours are required to cool the system. Thereafter the system may still fail the reflectance specification indicating excessive outgassing of oxygen into the chamber. Using the current art procedure, a minimum of three burn in test lots are required before passing the reflectance specification. Each of these test lots require approximately three hours. Therefore, the additional downtime after completing maintenance is at least fifteen hours.

Other approaches incorporating bake-out systems in vacuum chambers exist. U.S. Pat. No. 5,906,680 to Meyerson teaches a CVD system where a bake out is required prior to use of the system. In addition, baking of the wafer carrier is performed when the carrier is placed in the deposition chamber. U.S. Pat. No. 5,336,324 to Stall et al. teaches a method for depositing a coating on a wafer where chamber heating is used. U.S. Pat. No. 5,883,017 to Tepman et al. describe a method of cleaning a processing chamber where the chamber is baked out at an elevated temperature to help drive the water from the enclosure surfaces and thus provide a dry enclosure environment where a stable vacuum may be maintained. This bake out period typically lasts at least 8 hours.

SUMMARY OF THE INVENTION

A principal object of the present invention is to provide a method that reduces the pump down time for the transfer chamber in a high-vacuum metal deposition system.

Another object of the present invention is to provide a method that prevents absorption of moisture on the surfaces of the transfer chamber in a high-vacuum metal deposition system during maintenance.

Another object of the present invention is to provide a method that reduces downtime for both scheduled and unscheduled maintenance on a high-vacuum metal deposition system.

Another object of the present invention is to provide a method that increases kit life in a high-vacuum metal deposition system by decreasing burn-in time for the transfer chamber.

These objects are achieved using a system designed to warm the transfer chamber to a set temperature whenever the chamber lid is opened. This reduces moisture build-up on the inside surfaces of the chamber during maintenance, thereby reducing out gassing and time required to bring the chamber back to its base vacuum pressure.

BRIEF DESCRIPTION OF THE DRAWINGS

In the accompanying drawings forming a material part of this description, there is shown.

DESCRIPTION OF THE PREFERRED EMBODIMENTS

The present invention uses a system designed to warm the transfer chamber used in vacuum equipment in the manufacture of integrated circuits during maintenance. The system detects when the transfer chamber lid is opened and the chamber is exposed to the atmosphere. This activates the heater normally used to bake out the chamber. A temperature sensor is used to keep the temperature below a set point to avoid injury to the maintenance personnel. By warming the chamber, moisture build-up on the inside of the chamber during maintenance is reduced, thereby reducing out gassing and time required to bring the chamber back to its base vacuum pressure.

Figure 1:
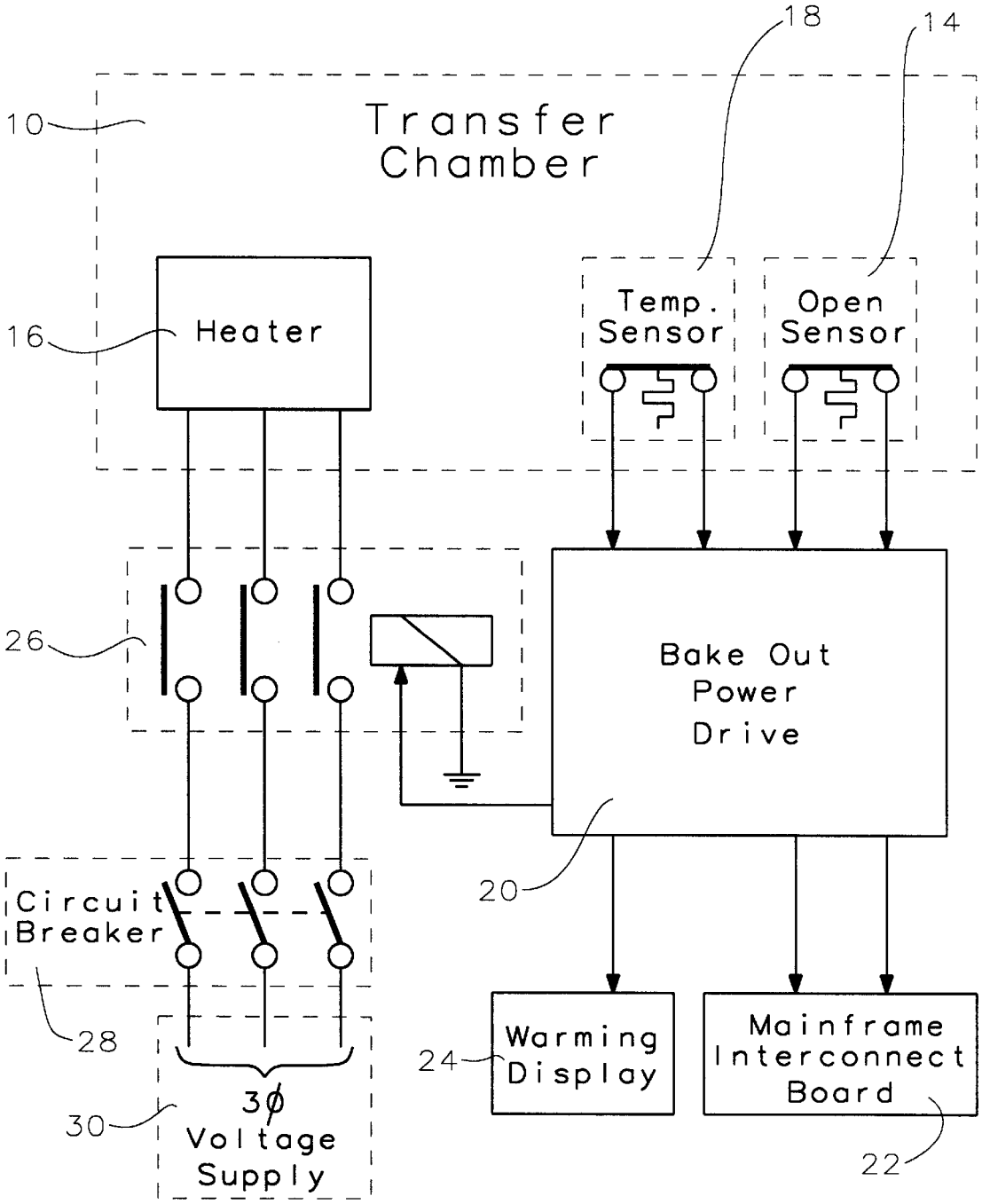
FIG. 1 schematically illustrating a block diagram of the present invention.

Referring to FIG. 1, a block diagram of one embodiment of the system is shown. The transfer chamber 10 is provided with an attached chamber lid (not shown). When the chamber lid is open the lid open sensor 14 which may be a reed switch, for example, will be open (high resistance) and when the chamber lid is closed, the lid open sensor 14 is closed (low resistance). Heating coils 16 line the walls of the transfer chamber 10. A temperature sensor 18 with a trip point between about 28 and 30° C. is placed inside the transfer chamber 10 to detect the chamber temperature. This temperature sensor 18 may be a thermal switch, for example. When the chamber temperature is below the trip point, the temperature sensor 18 will be closed (low resistance) and when the chamber temperature is above the trip point, the temperature sensor 18 will be open (high resistance). A bake out power driver 20 has inputs from the lid open sensor 14 and temperature sensor 18. The outputs of the bake out power driver 20 connect to the mainframe interconnect board 22, the warming display 24, and three-phase heater relay 26. A three-phase circuit breaker 28 allows for protection and disconnection of the heater from the three-phase voltage supply 30.

Figure 2:
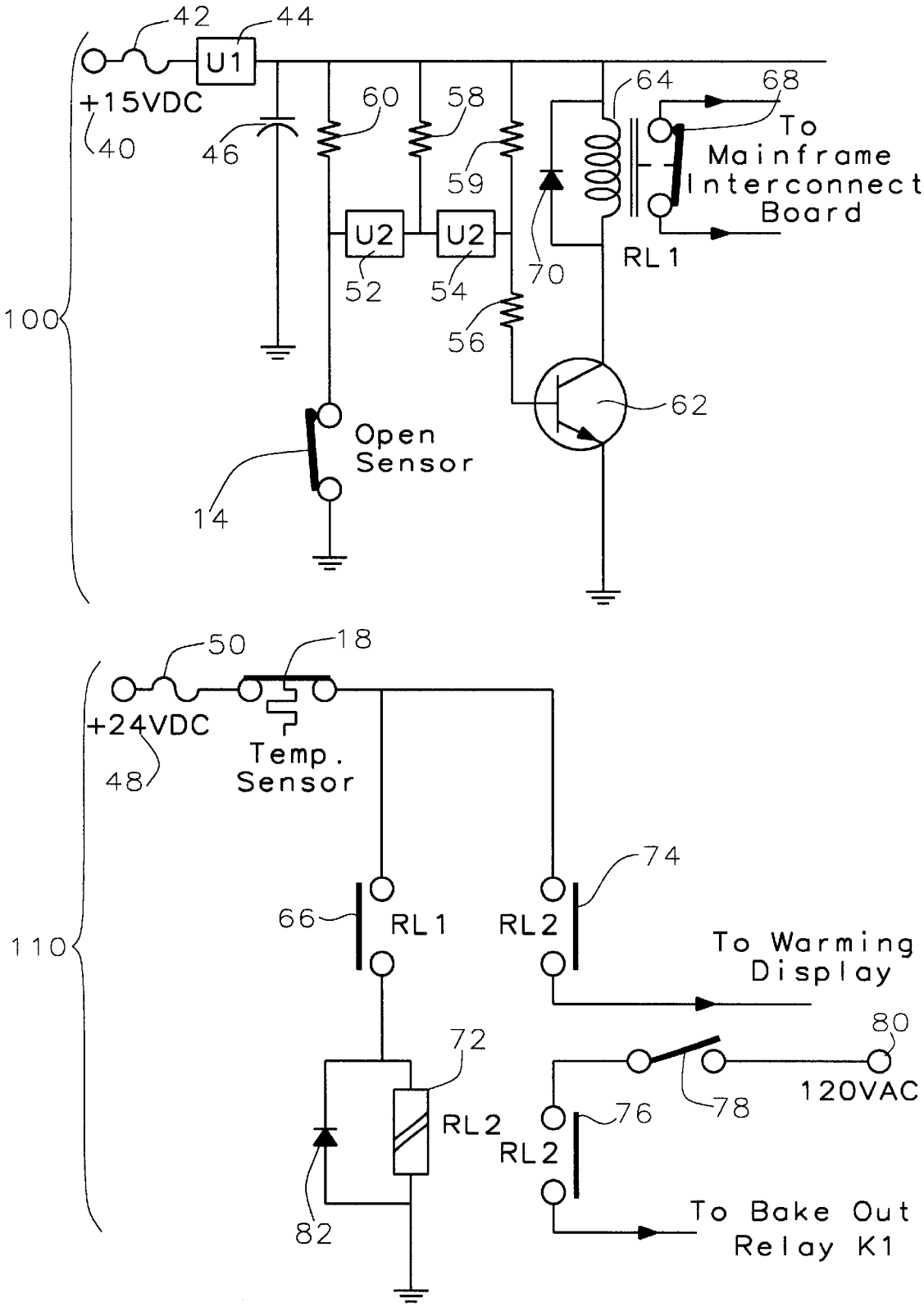
FIG. 2 schematically illustrating one embodiment of the bake out power driver of the present invention.

Referring to FIG. 2, one embodiment of the circuitry of the bake out power driver 20 is schematically shown. The lid position circuitry 100 is powered by a 15 VDC source 40 and is protected by a fuse 42, for example. Voltage regulator 44 and capacitor 46 eliminate any voltage transients on the voltage supply lines feeding the remainder of the circuit. The solenoid driver circuitry 110 is powered by a 24 VDC source 48 protected by a fuse 50.

Referring to FIGS. 1 and 2, the operation of the system is now described. When the chamber lid is closed, lid open sensor 14 has a low resistance and the input to Schmidt-trigger inverter 52 is pulled low (logic 0) by the lid open sensor 14. The output of the Schmidt-trigger inverter 52 will be high (logic 1) which is applied to the input to a second Schmidt-trigger inverter 54. Resistors 58 and 59 function as pull-up resistors for the outputs of inverters 52 and 54, respectively. The base of NPN transistor 62 is connected to the output of the second Schmidt-trigger inverter 54 through resistor 56. The output of the second inverter 54 will be low (logic 0) and NPN transistor 62 will be off. Relay coil 64 is not energized, so normally open contacts 66 and normally closed contacts 68 associated with relay coil 64 remain not activated (open and closed, respectively). Normally closed contacts 68 supply an open or closed connection to the mainframe interconnect board indicating the position of the chamber lid. Flyback diode 70 across the relay coil 64 prevents high voltage transients during coil de-energizing.

Still referring to FIGS. 1 and 2, when the chamber lid is open, lid open sensor 14 has a high resistance and the input to Schmidt-trigger inverter 52 is pulled high (logic 1) through resistor 60. The output of the Schmidt-trigger inverter 52 will be low (logic 0) which is applied to the input to a second Schmidt-trigger inverter 54. The output of the second Schmidt-trigger inverter 54 will be high (logic 1) turning on NPN transistor 62 by supplying base current through resistor 56. Relay coil 64 is energized, so normally open contacts 66 close while normally closed contacts 68 open, thereby indicating that the chamber lid is open.

When the chamber 10 temperature is below the trip point, the temperature sensor has a low resistance (closed switch) and connects the 24 VDC supply 48 to the remaining devices in the solenoid driver circuitry 110. When both the temperature sensor 18 and normally open contacts 66 are closed (chamber lid is open), relay coil 72 is energized. This closes normally open contacts 74 and 76. When closed, contacts 74 supply 24 VDC to the warming display 24 and contacts 76 connect a 120 VAC supply 80 to the three-phase heater relay 26 through circuit breaker 78. Under this condition, three-phase heater relay 26 is energized and the heater 16 will be on. Flyback diode 82 across the relay coil 72 prevents high voltage transients during coil de-energizing.

If the chamber lid is closed, normally open contacts 66 open and relay coil 72 is de-energized. This opens contacts 74 and 76 removing the 24 VDC from the warming display 24 and de-energizing the three-phase heater relay 26, thereby turning the heater off. Similarly, when the chamber 10 temperature is at or above the trip point, the temperature sensor 18 has a high resistance (open switch) and disconnects the 24 VDC supply 48 from the remaining devices in the solenoid driver circuitry 110. Relay coil 72 is de-energized thereby opening normally open contacts 74 and 76. This disconnects the 24 VDC supply from the warming display 24 and de-energizes the three-phase heater relay 26, turning the heater off.

Figure 3:
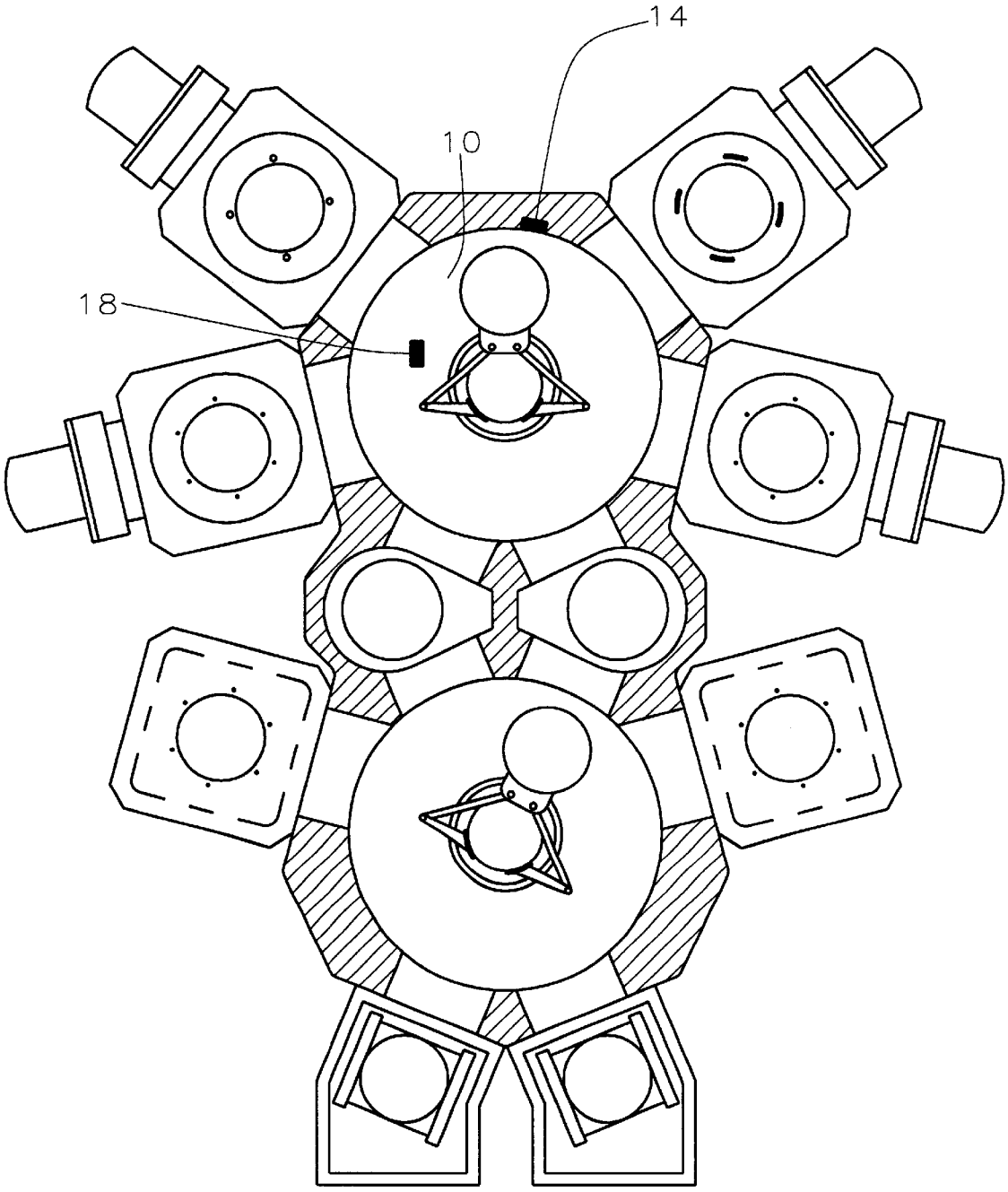
FIG. 3 schematically illustrating one embodiment of the present invention installed in an Applied Materials Endura system.

Referring now to FIG. 3 showing a cross section of a typical application of the present invention in an Applied Materials Endura system. The transfer chamber 10 is shown with possible locations for the open lid sensor 14 and temperature sensor 18.

In order to reduce moisture build-up during maintenance, the present invention heats the transfer chamber to a set temperature whenever the chamber lid is opened. This inhibits absorption of gasses into the chamber walls and thereby reduces out gassing and the time required to return the chamber back to its base vacuum pressure. To summarize the operation, if the chamber lid is closed or the chamber temperature is at or above the trip point, then the chamber heater will be turned off. When the chamber lid is open and the chamber temperature is below the trip point, the chamber heater will be on.

While the invention has been particularly shown and described with reference to the preferred embodiments thereof, it will be understood by those skilled in the art that various changes in form and details may be made without departing from the spirit and scope of the invention.

What is claimed is:

1. A chamber heater system used to prevent moisture accumulation in vacuum chambers comprising:

a heater;

a lid open sensor detecting when said chamber is open and exposed to atmospheric pressure;

a temperature sensor detecting when said chamber has reached a set temperature; and a bake out power driver circuit which activates said heater only when said chamber is open and said chamber temperature is below said set temperature and which deactivates said heater when said chamber reaches said set temperature or when said chamber is closed.

2. The chamber heater system according to claim 1 wherein said heater is not activated when said chamber is not open and not exposed to atmospheric pressure.

3. The chamber heater system according to claim 1 wherein said heater is not activated when said chamber temperature is above said set temperature.

4. The chamber heater system according to claim 1 wherein said heater is an inductive heating coil.

5. The chamber heater system according to claim 1 wherein said lid open sensor is a reed switch wherein said switch is open when said chamber is open and exposed to atmospheric pressure.

6. The chamber heater system according to claim 1 wherein said temperature sensor is a thermal switch.

7. The chamber heater system according to claim 1 wherein said temperature sensor opens when said chamber temperature reaches between about 28 to 30° C.

8. A chamber heater system used to prevent moisture accumulation in vacuum chambers comprising:

a heater;

a lid open sensor detecting when said chamber is open and exposed to atmospheric pressure;

a temperature sensor detecting when said chamber has reached a set temperature; and a bake out power driver circuit which activates said heater only when said chamber is below said set temperature and is open and exposed to atmospheric pressure.

9. The chamber heater system according to claim 8 wherein said heater is an inductive heating coil.

10. The chamber heater system according to claim 8 wherein said lid open sensor is a reed switch wherein said switch is open when said chamber is open and exposed to atmospheric pressure.

11. The chamber heater system according to claim 8 wherein said temperature sensor is a thermal switch.

12. The chamber heater system according to claim 8 wherein said temperature sensor opens when said chamber temperature reaches between about 28 to 30° C.

13. A chamber heater system used to prevent moisture accumulation in vacuum chambers comprising:

a heater;

a lid open sensor detecting when said chamber is open and exposed to atmospheric pressure wherein said lid open sensor is a reed switch wherein said switch is open when said chamber is open and exposed to atmospheric pressure;

a temperature sensor detecting when said chamber has reached a set temperature wherein said temperature sensor is a thermal switch; and a bake out power driver circuit which activates said heater only when said chamber is below said set temperature and is open and exposed to atmospheric pressure.

14. The chamber heater system according to claim 13 wherein said heater is an inductive heating coil.

15. The chamber heater system according to claim 13 wherein said temperature sensor opens when said chamber temperature reaches between about 28 to 30° C.

16. A method used to prevent moisture accumulation in a vacuum chamber wherein said vacuum chamber comprises:

a heater;

a lid open sensor detecting when said chamber is open and exposed to atmospheric pressure;

a temperature sensor detecting when said chamber has reached a set temperature; and a bake out power driver circuit wherein said method comprises:

activating said heater only when said chamber is below said set temperature and is open and exposed to atmospheric pressure;

and deactivating said heater when said chamber reaches said set temperature or when said chamber is closed.

17. The method according to claim 16 wherein said heater is an inductive heating coil.

18. The method according to claim 16 wherein said lid open sensor is a reed switch wherein said switch is open when said chamber is open and exposed to atmospheric pressure.

19. The method according to claim 16 wherein said temperature sensor is a thermal switch.

20. The method according to claim 16 wherein said temperature sensor opens when said chamber temperature reaches between about 28 to 30° C.

21. A method used to prevent moisture accumulation in a vacuum chamber wherein said vacuum chamber comprises:

a heater;

a lid open sensor detecting when said chamber is open and exposed to atmospheric pressure wherein said lid open sensor is a reed switch wherein said switch is open when said chamber is open and exposed to atmospheric pressure;

a temperature sensor detecting when said chamber has reached a set temperature wherein said temperature sensor is a thermal switch; and a bake out power driver circuit wherein said method comprises:

activating said heater only when said chamber is below said set temperature and is open and exposed to atmospheric pressure;

and deactivating said heater when said chamber reaches said set temperature or when said chamber is closed.

22. The method according to claim 21 wherein said heater is an inductive heating coil.

23. The method according to claim 21 wherein said temperature sensor opens when said chamber temperature reaches between about 28 to 30° C.

* * * * *